US007614719B2

(12) United States Patent
Iriguchi et al.

(10) Patent No.: US 7,614,719 B2
(45) Date of Patent: Nov. 10, 2009

(54) INKJET PRINTER AND INKJET HEAD WITH MODIFICATION OF DRIVING WAVEFORM DATA

(75) Inventors: Akira Iriguchi, Ichinomiya (JP); Masatomo Kojima, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/168,705

(22) Filed: Jul. 7, 2008

(65) Prior Publication Data

US 2008/0284806 A1 Nov. 20, 2008

Related U.S. Application Data

(62) Division of application No. 11/367,399, filed on Mar. 6, 2006, now Pat. No. 7,410,236.

(30) Foreign Application Priority Data

Mar. 4, 2005 (JP) ..... 2005-060425

(51) Int. Cl.
*B41J 29/393* (2006.01)

(52) U.S. Cl. ..... 347/19; 347/10; 347/11

(58) Field of Classification Search ..... 347/10, 347/11, 19

See application file for complete search history.

(56) References Cited

U.S. PATENT DOCUMENTS

| | | | | |
|---|---|---|---|---|
| 5,039,237 | A | 8/1991 | Tanuma et al. | |
| 5,402,159 | A | 3/1995 | Takahashi et al. | |
| 6,273,542 | B1 * | 8/2001 | Couwenhoven et al. | 347/19 |
| 6,663,208 | B2 | 12/2003 | Suzuki et al. | |
| 7,018,010 | B2 * | 3/2006 | Kobayashi et al. | 347/19 |
| 7,201,462 | B2 * | 4/2007 | Shibata et al. | 347/19 |

FOREIGN PATENT DOCUMENTS

| | | | |
|---|---|---|---|
| JP | H63-302060 | B2 | 12/1988 |
| JP | H01-075257 | B2 | 3/1989 |
| JP | H04-033470 | A | 2/1992 |
| JP | H04-135860 | A | 5/1992 |
| JP | H04-341853 | A | 11/1992 |
| JP | H09-141905 | A | 6/1997 |
| JP | 2002-160362 | A | 6/2002 |
| JP | 2002-225287 | A | 8/2002 |

* cited by examiner

*Primary Examiner*—Matthew Luu
*Assistant Examiner*—Brian J Goldberg
(74) *Attorney, Agent, or Firm*—Baker Botts L.L.P.

(57) ABSTRACT

A testing method includes sorting inkjet heads into a plurality of groups on the basis of known information about ink flow, preparing basic driving waveform data corresponding to each of the groups and modification data that partially modifies the basic driving waveform data to individually store them in advance in a storing section, creating individual waveform information that instructs combinations of the basic driving waveform data with the modification data with respect to an inkjet head to be tested to apply a modified driving waveform, and repeating the modification of the individual waveform information until a recording state becomes good.

13 Claims, 10 Drawing Sheets

FIG. 10A

| GROUP OF HEAD | | SET NUMBER | USED WAVEFORM NO. | | |
|---|---|---|---|---|---|
| | | | FOR SMALL DROP | FOR MIDDLE DROP | FOR LARGE DROP |
| X | → | 1 | 1 | 2 | 3 |
| Y | → | 2 | 1 | 2 | 4 |
| Z | → | 3 | 1 | 2 | 5 |

FIG. 10B

| WAVEFORM NO. | TYPE OF WAVEFORM | CONTENTS OF BASIC WAVEFORM DATA | | | | | |
|---|---|---|---|---|---|---|---|
| | | PULSE WIDTH FOR EACH PULSE ($\mu$ sec) | | | | | |
| | | 1(A) | 2(B) | 3(C) | 4(D) | 5(E) | 6(F) |
| 1 | SMALL DROP WAVEFORM | 3 | 3.8 | 3.5 | 1.8 | | |
| 2 | MIDDLE DROP WAVEFORM | 2 | 6 | 8 | 7.2 | | |
| 3 | LARGE DROP WAVEFORM I | 1 | 6 | 5 | 6 | 9.6 | 7 |
| 4 | LARGE DROP WAVEFORM II | 0 | 5 | 5 | 5 | 8.8 | 7 |
| 5 | LARGE DROP WAVEFORM III | 0 | 6 | 4 | 6 | 8 | 7 |

FIG. 10C

| MODIFICATION NO. | WAVEFORM NO. TO BE APPLIED | CONTENTS OF MODIFICATION DATA | | | | | | |
|---|---|---|---|---|---|---|---|---|
| | | START WAVEFORM NO. | NUMBER OF WAVEFORMS | INCREMENT | PULSE NAME | UNIT MODIFICATION AMOUNT | PULSE NAME | UNIT MODIFICATION AMOUNT |
| 1 | 1 | 1 | 1 | 1 | 2 | 0.1 | | |
| 2 | 1.2 | 1 | 2 | 1 | 3 | 0.3 | | |
| 3 | 3 | 3 | 1 | 1 | 2 | 0.2 | 4 | 0.2 |
| 4 | 3.4 | 3 | 2 | 1 | 3 | 0.2 | | |
| 5 | 3.5 | 3 | 2 | 2 | 2 | 0.2 | 4 | 0.2 |
| 6 | 5 | 5 | 1 | 1 | 3 | 0.2 | 4 | -0.2 |

FIG. 10D

| MULTIPLYING FACTOR NO. | CONTENTS OF MULTIPLYING FACTOR DATA |
|---|---|
| 1 | -2 |
| 2 | -1 |
| 3 | 1 |
| 4 | 2 |

FIG. 10E

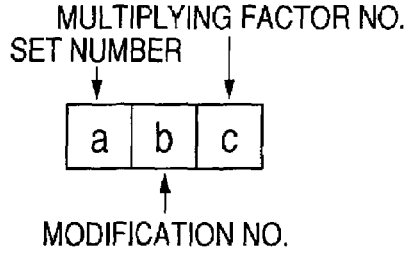

INKJET PRINTER AND INKJET HEAD WITH MODIFICATION OF DRIVING WAVEFORM DATA

CROSS REFERENCE TO RELATED APPLICATION

This application is a divisional of U.S. patent application Ser. No. 11/367,399, filed on Mar. 6, 2006, which claims priority from Japanese Patent Application No. 2005-060425, filed on Mar. 4, 2005, the entire subject matter of which are incorporated herein by reference.

TECHNICAL FIELD

Aspects of the present invention relate to a method of testing an inkjet head to be applied to image forming apparatuses, etc., a testing system, and an inkjet printer.

BACKGROUND

As conventional inkjet heads, JP-A-2002-160362 (refer to FIGS. 1 and 3) discloses a structure including a plurality of nozzles provided on a front side, pressure chambers provided on a back side to communicate with the nozzles, respectively, a cavity unit adapted to distribute ink from an ink supply source to each pressure chamber via a common ink chamber, and a piezoelectric actuator laminated on and bonded to a back surface of the cavity unit.

According to the structure of this inkjet head, when the piezoelectric actuator is selectively supplied with a driving waveform (a driving pulse signal), the actuator is deformed to change the volume of the pressure chambers to apply ejection pressure to ink. Then, ink drops are ejected from the nozzles communicating with the pressure chambers, thereby forming ink dots on a recording medium. The driving waveform to be applied to the piezoelectric actuator is determined in advance according to design specification of the inkjet head.

SUMMARY

Meanwhile, since ink flow passages formed within the cavity unit of the inkjet head are extremely fine, if there is any slight variation in finished dimensions of each portion of the cavity unit, the variation has a great effect on ejection characteristics of the head. In other words, if there is any variation in the length or flow passage resistance of the ink flow passages, the same recording quality is not necessarily obtained, even if the same driving waveforms are used. If pressure waves exist even after ejection of ink drops, satellites (extra ink drops that land on a recording medium), which are pointed out in JP-A-2002-160362, are often generated to greatly deteriorate inherent recording quality.

Accordingly, a method of minutely adjusting the driving waveform in accordance with a variation in every inkjet head is considered. For that purpose, there has been a method in which a number of kinds of waveforms are stored in advance in a memory (ROM) to be mounted on a testing device (the testing device having almost the same construction as image forming apparatuses) that tests inkjet heads, and an optimal driving waveform is found out by observing a recording state while the driving waveforms are changed.

However, in this method, in order to store a number of kinds of driving waveforms, memories (ROMs, etc.) having a large storage capacity are prepared. In this case, it is necessary to prepare a plurality of memories to store different waveforms and appropriately exchange them with each other.

As a result, in addition to an increase in manufacturing cost, the work for determining the driving waveform was complicated. Accordingly, simplifying the work that optimizes a driving waveform for every inkjet head to the utmost and thereby improving the manufacturing efficiency have been demanded.

The invention provides a testing method, a testing system, and an inkjet printer which can efficiently determine an optimal driving waveform for every inkjet head and can reduce the manufacturing cost.

According to an aspect of the invention, there is provided a method of testing an inkjet head, the inkjet head including a plurality of nozzles, a plurality of pressure chambers communicating with the nozzles, respectively, a cavity unit having an ink flow passage along which ink from an ink supply source reaches to the nozzles via the pressure chambers, and an actuator that is displaced by application of a driving waveform to selectively apply ejection pressure to each pressure chamber, the inkjet head ejecting ink drops from the nozzles to perform recording on a recording medium, the method including: sorting inkjet heads into a plurality of groups on the basis of known information about ejection characteristics of the inkjet heads, and preparing a plurality of kinds of basic driving waveforms that correspond to respective groups; storing the plurality of kinds of basic driving waveforms in a storing section as basic driving waveform data in association with identification information of the basic driving waveforms; storing a plurality of kinds of modification data to partially modify the basic driving waveform data in association with identification information; determining, with respect to an inkjet head to be tested, basic driving waveform data to be applied to the inkjet head on the basis of the group to which the inkjet head belongs, and creating individual waveform information including the identification information of the determined basic driving waveform data and information showing that the basic driving waveform data is not modified; creating the driving waveform without modifying the basic driving waveform data on the basis of the created individual waveform information, and ejecting ink drops onto a recording medium on the basis of the created driving waveform; creating new individual waveform information when a recording state on the recording medium is bad by changing the individual waveform information so as to include the identification information of the determined basic driving waveform data and the identification information of the modification data to modify the basic driving waveform data; and modifying the basic driving waveform data according to the modification data to create a new driving waveform on the basis of the recreated driving waveform information when the recording state on the recording medium is bad, and ejecting the ink drops onto the recording medium on the basis of the new driving waveform, wherein the driving waveform to be applied to the actuator is created by repeating the modification of the individual waveform information until the recording state on the recording medium becomes good.

According to the aspect of the invention, since the driving waveform applied to each inkjet head is created based on the basic driving waveform data or by combinations of the basic driving waveform data with the modification data, even if a number of driving waveforms are not prepared and stored in advance, various driving waveforms can be created, and thereby the manufacturing cost can be reduced by virtue of the reduction in storage capacity.

Further, since the basic driving waveform data is selected in advance based on known information about inkjet heads, a burden of work to adapt driving waveforms to the inkjet heads can be reduced.

Moreover, the inkjet heads can be driven in their optimal states on the basis of information on driving waveforms inherent to the heads.

BRIEF DESCRIPTION OF THE DRAWINGS

Illustrative aspects of the invention may be more readily described with reference to the accompanying drawings:

FIG. 10A is a table showing combinations of driving waveforms, FIG. 10B is a table showing contents of basic driving waveform data, FIG. 10C is a table showing contents of modification data, FIG. 10D is a table showing contents of multiplying factor data, and FIG. 10E is a diagram showing the configuration of individual waveform information.

DETAILED DESCRIPTION

Figure 1:
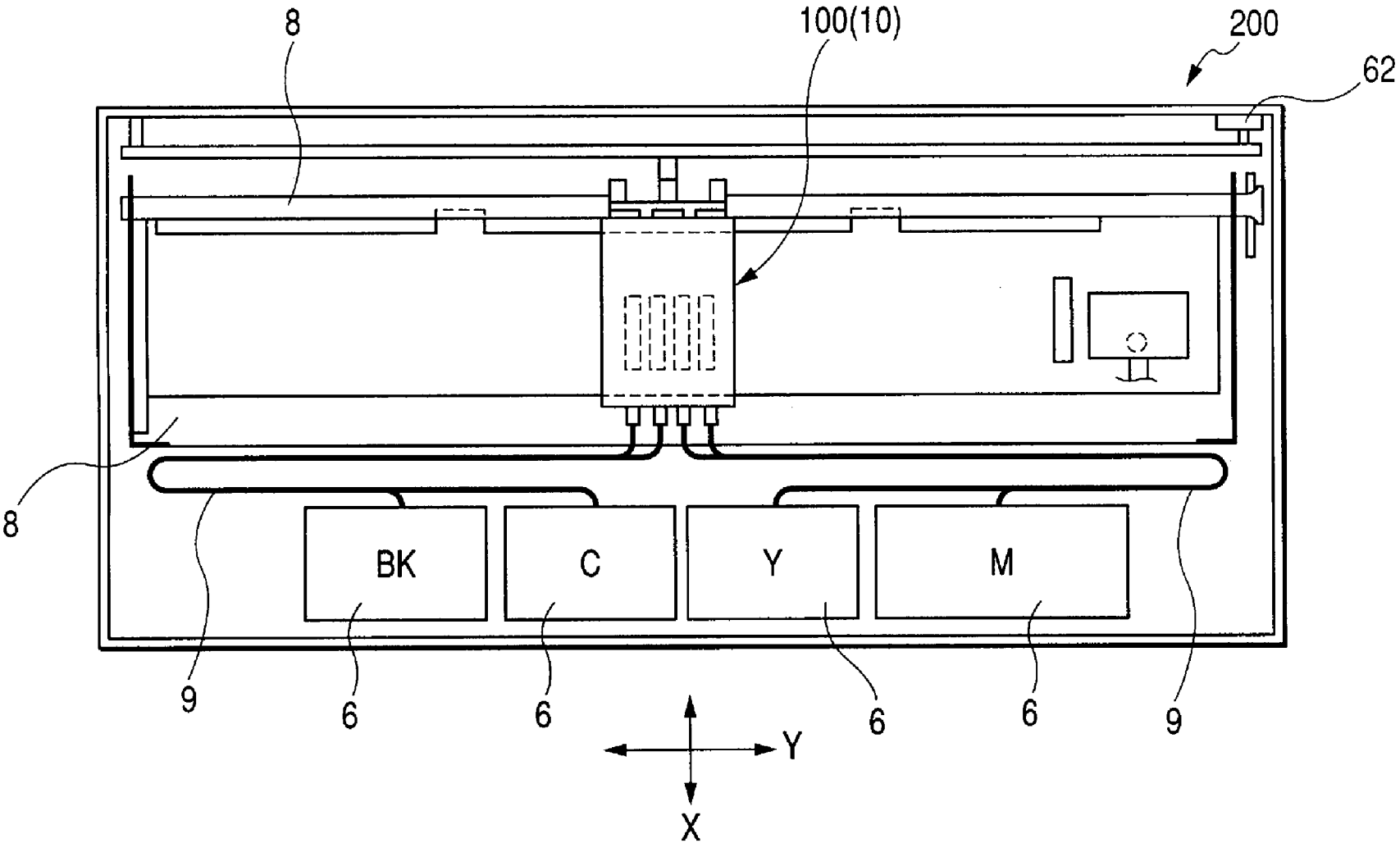
FIG. 1 is a schematic plan view of an inkjet printer to which the invention is applied.
Figure 2:
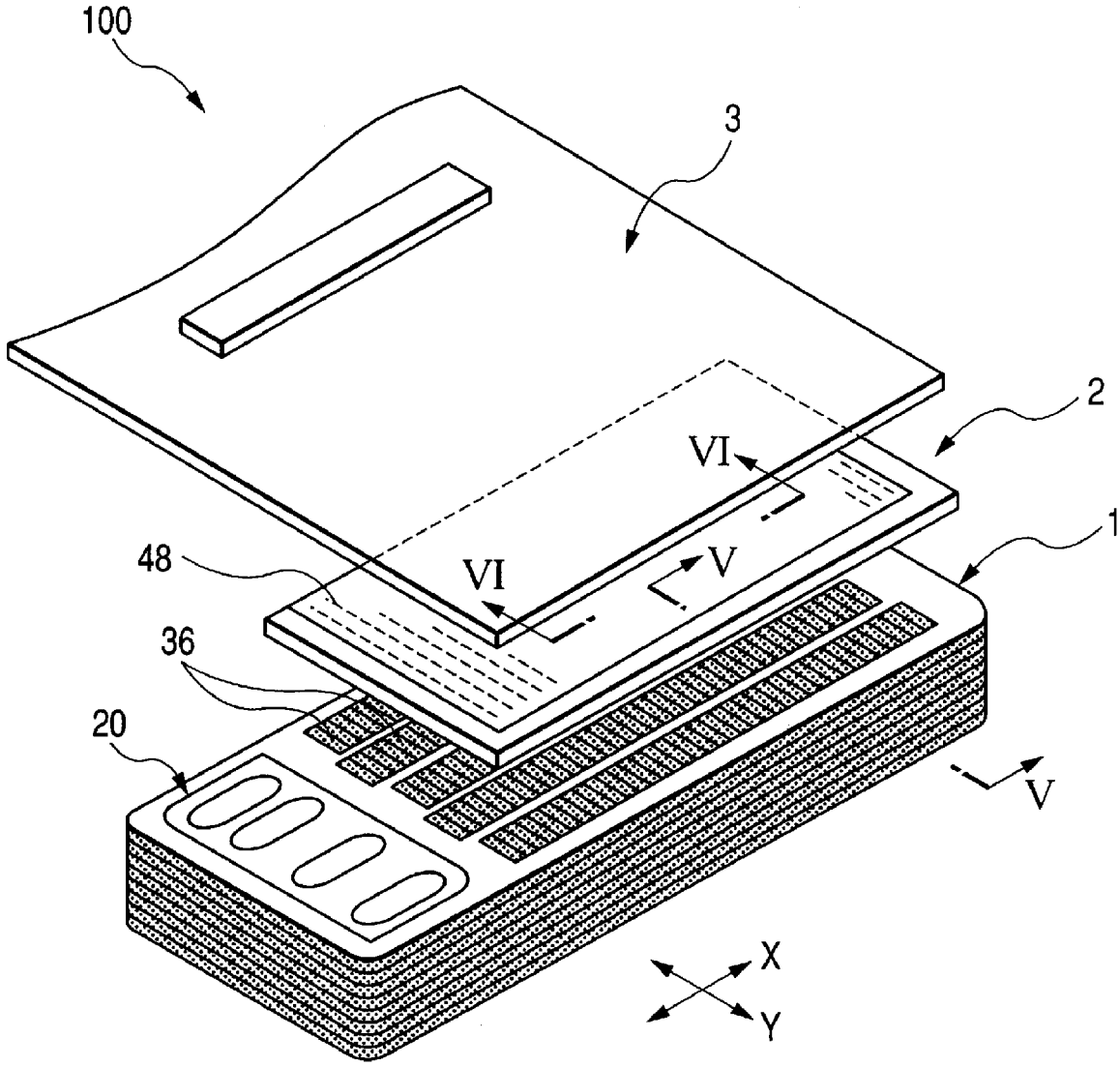
FIG. 2 is a perspective view of an inkjet head of an aspect.
Figure 3:
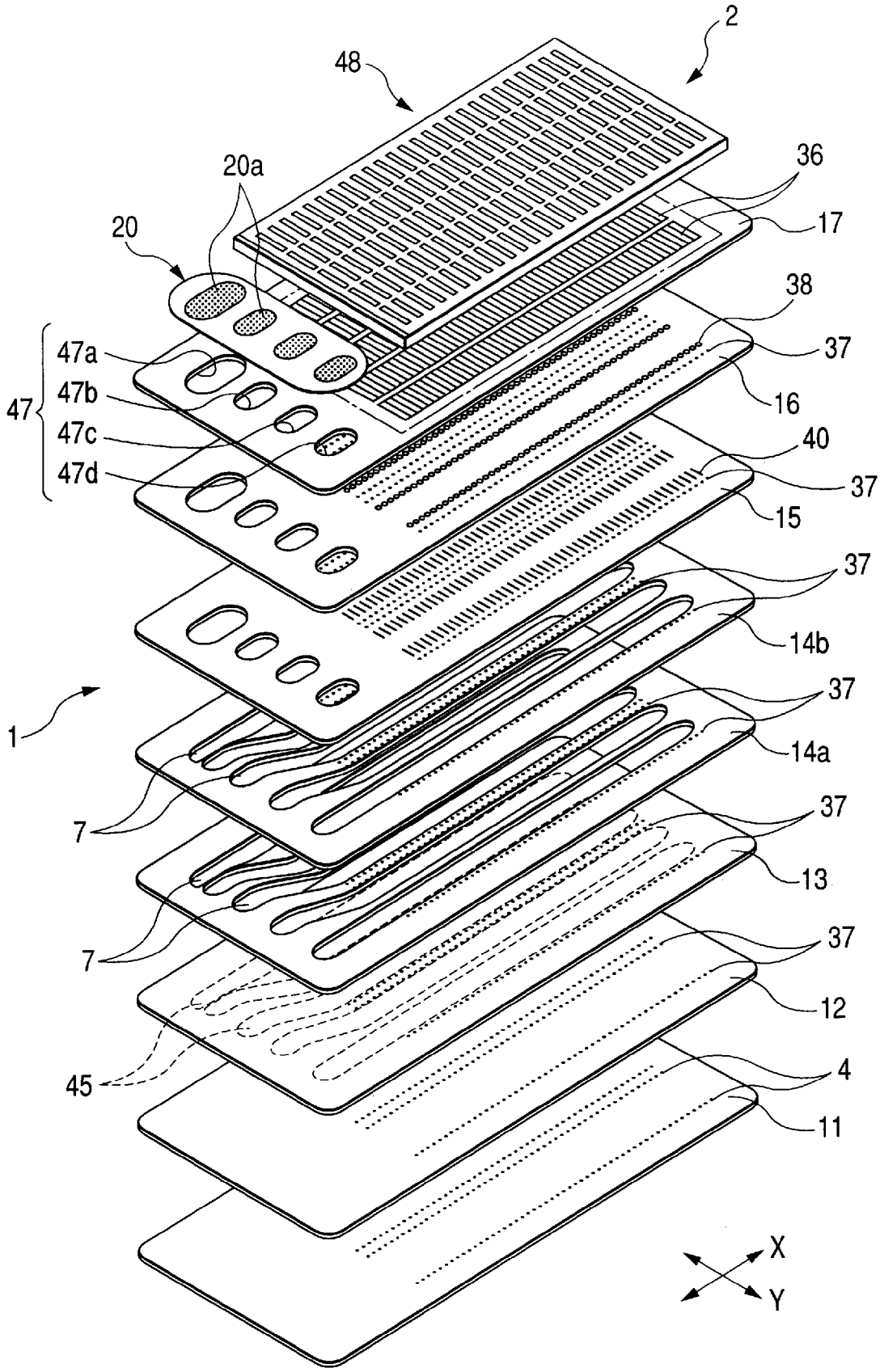
FIG. 3 is an exploded perspective view of the inkjet head.
Figure 4:
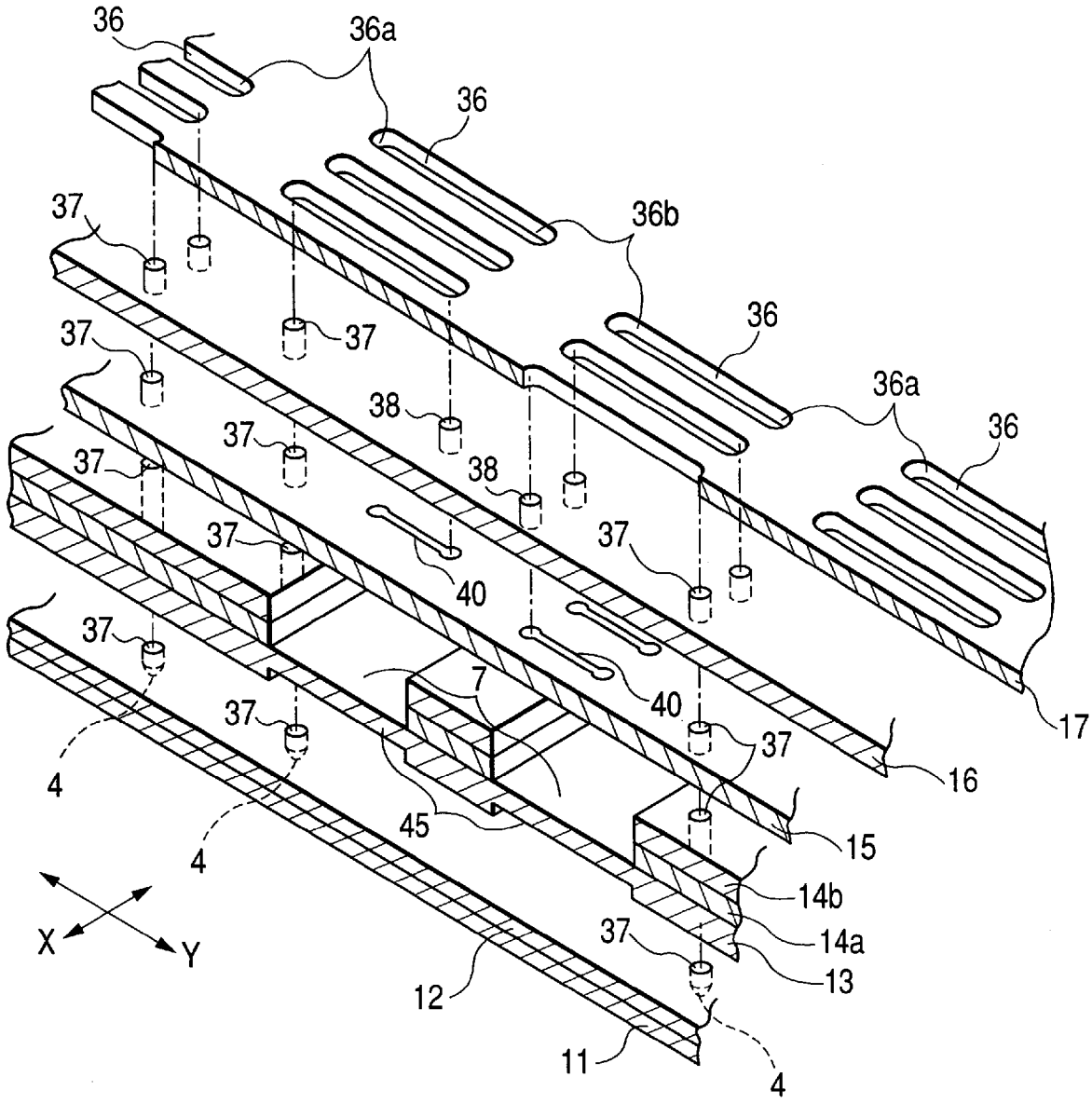
FIG. 4 is an enlarged exploded perspective view of a cavity unit.
Figure 5:
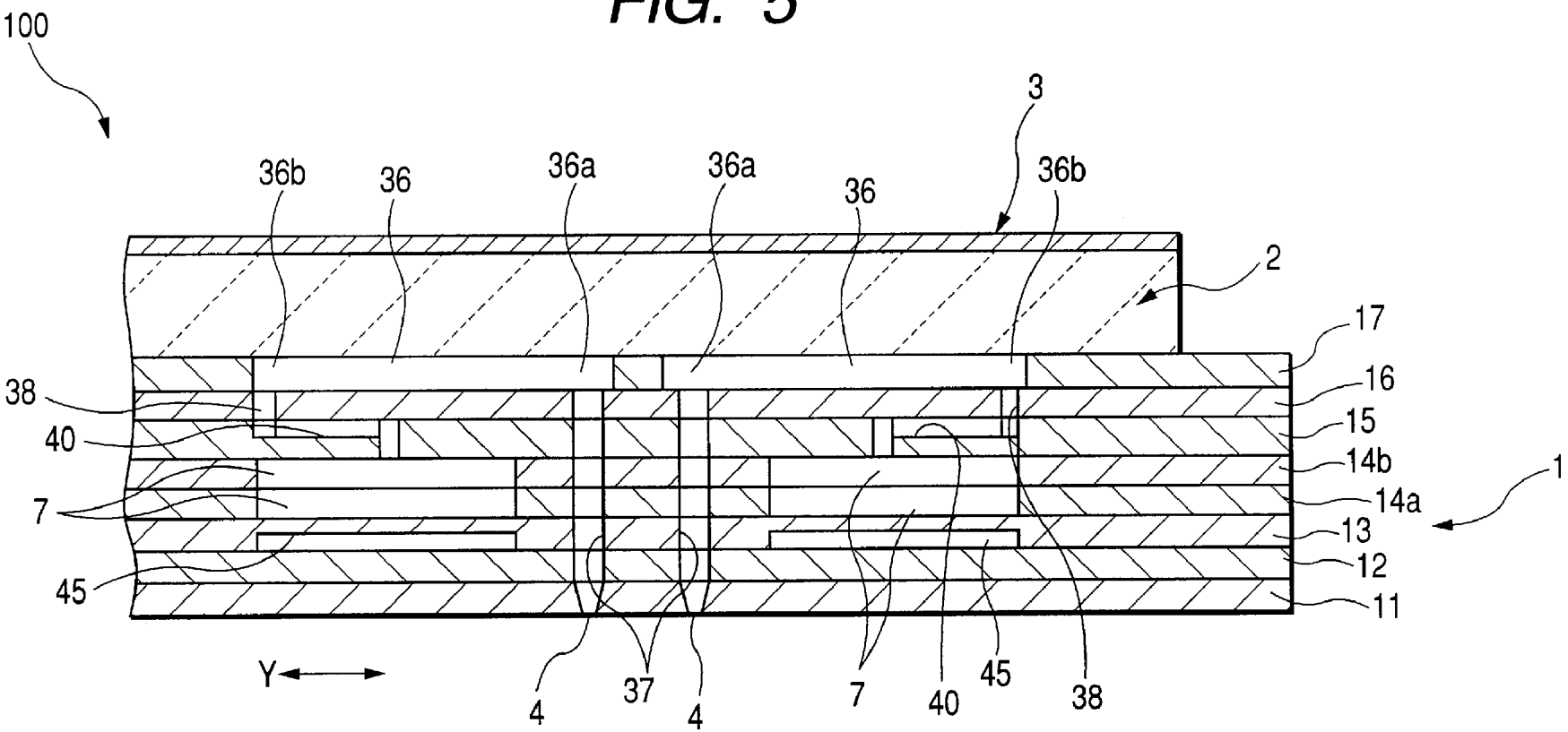
FIG. 5 is an enlarged sectional view taken along the line V-V of FIG. 2.
Figure 6:
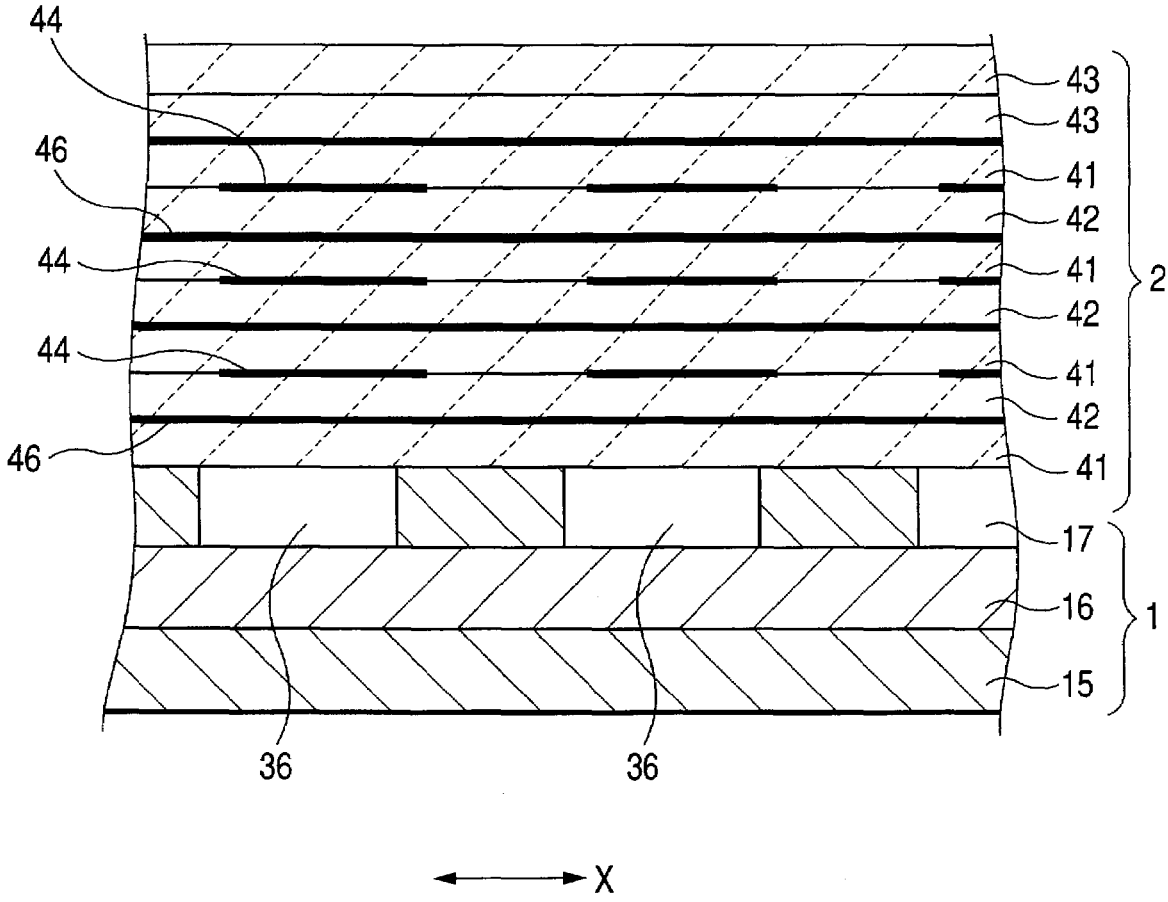
FIG. 6 is an enlarged sectional view taken along the line VI-VI of FIG. 2.
Figure 7:
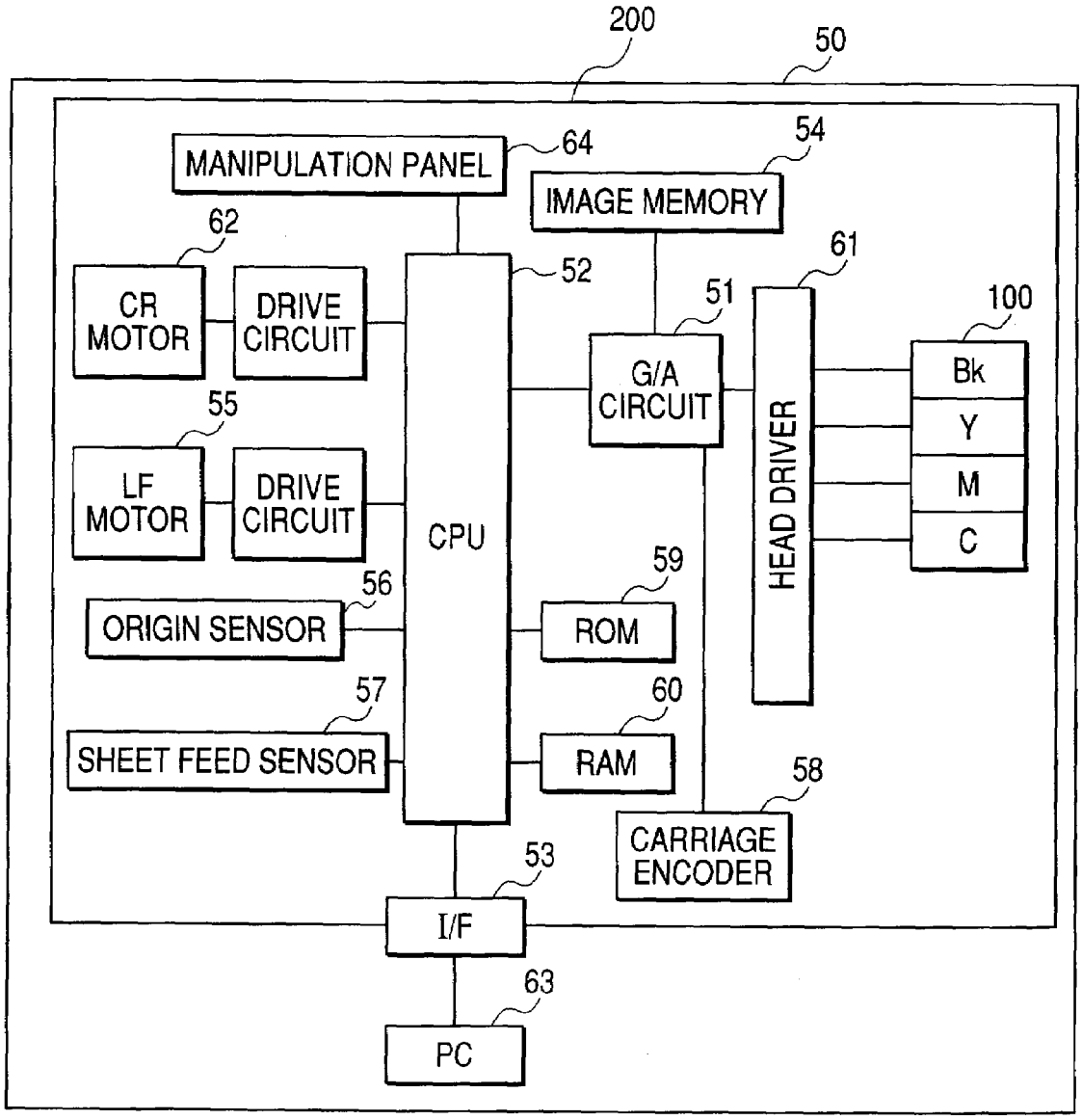
FIG. 7 is a block diagram showing the configuration of a testing system of the aspect.
Figure 8:
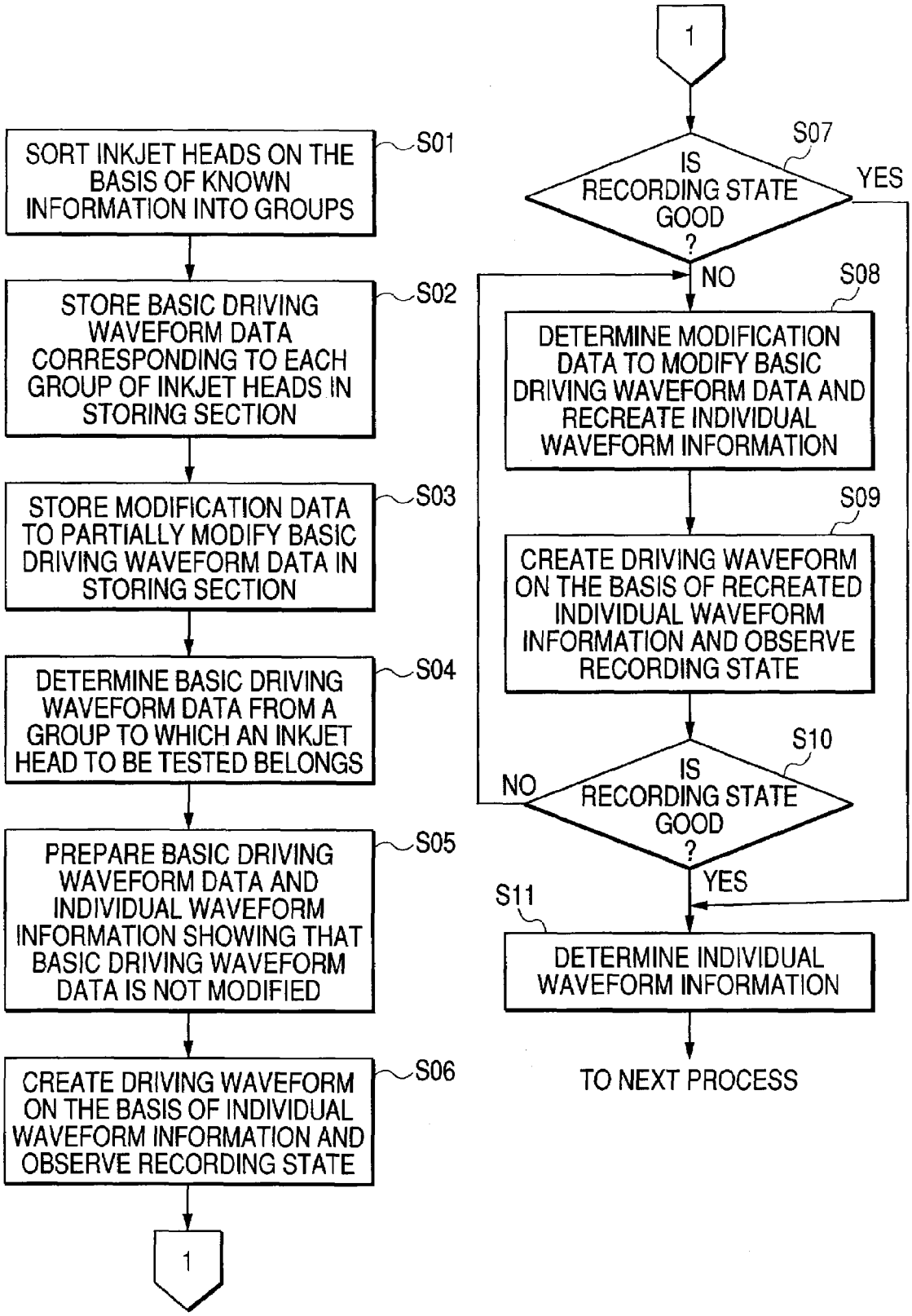
FIG. 8 is a flow chart of a testing method.
Figure 9:
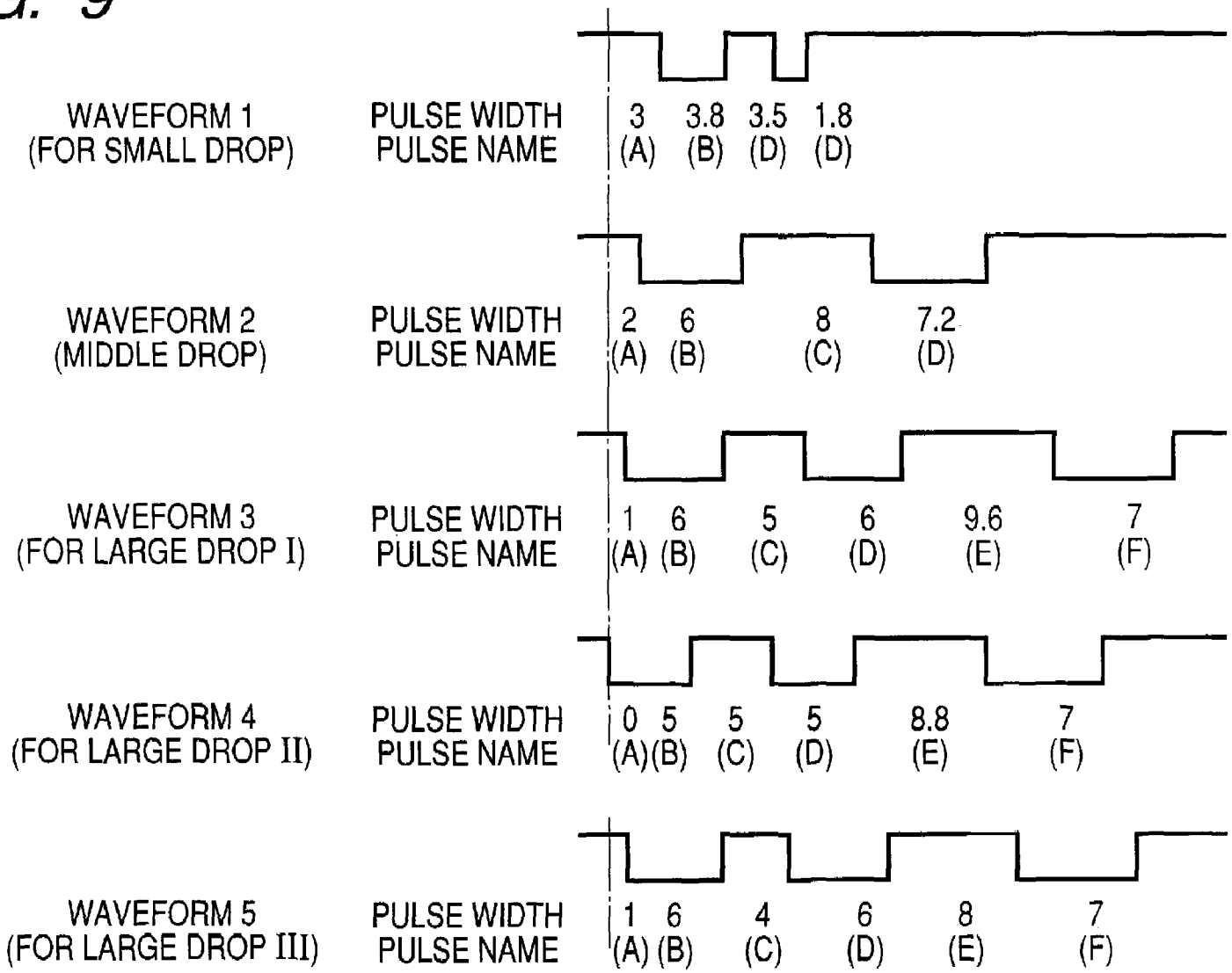
FIG. 9 is a time chart of driving waveforms.

Hereinafter, aspects of the invention will be described with reference to the accompanying drawings. FIG. 1 is a schematic plan view of an inkjet printer to which the invention is applied. FIG. 2 is a perspective view of an inkjet head of an aspect. FIG. 3 is an exploded perspective view of the inkjet head. FIG. 4 is an enlarged exploded perspective view of a cavity unit. FIG. 5 is an enlarged sectional view taken along the line V-V of FIG. 2. FIG. 6 is an enlarged sectional view taken along the line VI-VI of FIG. 2. FIG. 7 is a block diagram showing the configuration of a testing system of the aspect. FIG. 8 is a flow chart of a testing method. FIG. 9 is a time chart of driving waveforms. FIG. 10A is a table showing combinations of driving waveforms, FIG. 10B is a table showing contents of basic driving waveform data, FIG. 10C is a table showing contents of modification data, FIG. 10D is a table showing contents of multiplying factor data, and FIG. 10E is a diagram showing the configuration of individual waveform information.

An inkjet head 100 of this aspect is applied to an inkjet printer (image forming apparatus) 200 as shown in FIG. 1. This inkjet head is mounted on the lower surface of a carriage 10 that is slidably provided along two guide rails 8 provided parallel to each other, and is provided so as to reciprocate in a direction (main scanning direction, hereinafter referred to as "Y-direction") orthogonal to a conveyance direction (sub-scanning direction, referred to as "X-direction") of a recording medium. Inks of respective colors (for example, four coolers of cyan, magenta, yellow and black) are individually supplied to the inkjet head 100 via supply pipes 9 from an ink cartridge 6 that is stationarily placed in a main body of the inkjet printer 200. The ink cartridge may be detachably mounted on the carriage 10.

In the inkjet head 100, as shown in FIG. 2, a plate-type piezoelectric actuator 2 is bonded to a cavity unit 1 composed of a plurality of plates, and a flexible flat cable 3 (see FIG. 5) is superposed on and bonded to an upper surface (back surface) of the plate-type piezoelectric actuator 2 for connecting with external equipment. In addition, ink is ejected through nozzles 4 formed on the lower surface (front surface) side of the cavity unit 1.

The cavity unit 1 has formed therein ink flow passages that allows the ink from an ink supply source to be ejected through the nozzles 4. As shown in FIG. 3, the cavity unit has a structure in which a total of eight thin plates, i.e., a nozzle plate 11, a spacer plate 12, a damper plate 13, two manifold plates 14*a* and 14*b*, a supply plate 15, a base plate 16, and a cavity plate 17 are superposed and bonded together with adhesive.

In this aspect, each of the plates 11 to 17 has a thickness of about 50 to 150 μm, and the nozzle plate 11 is made of synthetic resin, such as polyimide, and the other plates 12 to 17 are made of alloy steel plate containing 42% of nickel. A large number of ink-ejecting nozzles 4 having a minute diameter (about 25 μm) are bored at minute intervals in the nozzle plate 11. The nozzles 4 are arrayed in five rows parallel to a long side direction (X-direction) in the nozzle plate 11.

As shown in FIG. 3, a plurality of pressure chambers 36 are arrayed in five rows in a zigzag pattern parallel to the long side direction (X-direction) of the cavity plate 17. In this aspect, the pressure chambers 36 are formed in an elongated shape in plan view, and they are bored such that their long side direction runs along the short side direction (Y-direction) of the cavity plate 17. One end 36*a* of each of the pressure chambers communicate with the corresponding nozzle 4 and the other end 36*b* of each of the pressure chambers communicates with a common ink chamber 7 as will be described later.

The leading end 36*a* of each pressure chamber 36*a* communicates with each nozzle 4 of the nozzle plate 4 via corresponding communication holes 37 having a minute diameter, which are bored in the supply plate 15, the base plate 16, the two manifolds 14*a* and 14*b*, the damper plate 13 and the spacer plate 12.

A communication hole 38 to be connected to the other end 36*b* of each pressure chamber 36 is bored in the base plate 16 adjacent to the lower surface of the cavity plate 17.

A connecting flow passage 40 to supply ink to each pressure chamber 36 from a common ink chamber 7 as will be described below is provided on the supply plate 15 adjacent to the base plate 15. Each connecting flow passage 40 includes an inlet hole that introduces ink from the common ink chamber 7, an outlet hole opened to each pressure chamber 36 (through hole 38), and a narrowed portion that is located between the inlet hole and the outlet hole and formed to have a reduced cross-sectional area so as to have a highest flow passage resistance in the connecting flow passage 40.

Each of the two manifold plates 14*a* and 14*b* is formed with five common ink chambers 7 that are elongated along the long side direction (X-direction) of the plate and pass through the plate in their thickness direction. The common ink chambers extend along the respective rows of the nozzles 4. In other words, as shown in FIGS. 3 and 5, the two manifold plates 14*a* and 14*b* are laminated on each other, the upper surface of the laminated plates is covered with the supply plate 15, and the lower surface of the laminated plates is covered with the damper plate 13. As a result, a total of five common ink chambers (manifold chambers 7) are formed in a closed shape. In plan view as seen from the laminating direction of the respective plates, each common ink chamber 7 overlaps some of the pressure chambers 36 and extends lengthwise along the row direction (row direction of the nozzles 4) of the pressure chambers 36.

As shown in FIGS. 4 and 5, damper chambers 45, which are isolated from the common chambers 7, are concavely formed on the lower surface side of the damper plate 13 adjacent to the lower surface of the manifold plate 14*a*. The position and shape of each damper chamber 45, as shown in FIG. 3, are made coincide with those of each common chamber 7. Since the damper plate 13 can be made of metallic material that can be appropriately deformed elastically, a thin plate-shaped ceiling above the damper chambers 45 can vibrate both to the side of the common ink chambers 7 and to the side of the damper chambers 45. Thus, even if any pressure fluctuations generated in the pressure chambers 36 propagate to the common ink chambers 7 during ejection of ink, the ceiling elastically deforms and vibrates. As a result, a damper effect that the pressure fluctuations are absorbed and attenuated is exhibited. This reduces so-called crosstalk that the pressure fluctuations propagate to other pressure chambers 36.

As shown in FIG. 3, four ink supply ports 47 are bored in an end in the vicinity of one short side of each of the cavity plate 17, the base plate 16 and the damper plate 15 such that their upper and lower positions are made correspond to each other. The ink from an ink supply source communicates with one end of each common ink chamber 7 from the ink supply ports 47. The four ink supply ports 47 are denoted by 47*a*, 47*b*, 46*c* and 46*d* sequentially from the left of FIG. 3.

In an ink flow passage that lead to each nozzle 4 from each ink supply port 47, ink is supplied to each common ink chamber 7 as an ink supply channel from the ink supply port 47. Thereafter, as shown in FIG. 4, the ink is distributed via the connecting flow passage 40 of the supply plate 15 and the through hole 38 of the base plate 16. Then, as will be described later, driving the piezoelectric actuator 2 allows the ink to reach the nozzle 37 corresponding to each pressure chamber 36 through the communicating hole 37 from inside the pressure chamber 36. Then, when ejection pressure is applied to each pressure chamber 36 by driving of the piezoelectric actuator 2 as will be described later, pressure waves are transmitted to the nozzle 4 through the communicating hole 37 from inside from the pressure chamber 36, thereby ejecting the ink.

In this aspect, as shown in FIG. 3, the four ink supply ports 47 are provided, while the five common ink chambers 5 are provided. Only the ink supply port 47*a* is connected to the two common ink chambers 7 and 7. The ink supply port 47*a* is adapted to be supplied with black ink. This is designed in consideration of the fact that the use frequency of the black ink is higher than that of the other color inks. The other ink supply ports 47*b*, 47*c* and 47*d* are individually supplied with respective inks of yellow, magenta and cyan. Adhered to the ink supply ports 47*a*, 47*b*, 47*c* and 47*d* is a filter element 20 having filtering portions 20*a* corresponding to the openings of the ports with adhesive (refer to FIG. 2).

On the other hand, similar to the known structure disclosed in JP-A-4-341853, as shown in FIG. 6, a plurality of piezoelectric sheets 41 to 43 each having a thickness of about 30 μm are laminated, and narrow individual electrodes 44 are formed on the upper surfaces (wide surfaces) of a predetermined number of even piezoelectric sheets 42 from the bottom, among the piezoelectric sheets. The individual electrodes are formed in a row along a long side direction (X-direction) in points corresponding to the pressure chambers 36, respectively, of the cavity unit 1. A common electrode 46 that is common to the plurality of pressure chambers 36 is formed on the upper surfaces (wide surfaces) of a predetermined number of odd piezoelectric sheets 41 from the bottom. The upper surface of the uppermost sheet is provided with a surface electrode 48 electrically connected to each of the individual electrodes corresponding to the laminating direction and a surface electrode electrically connected to each common electrode.

As is known, a high voltage is applied between the individual electrodes 44 and the common electrode 46, whereby a portion of a piezoelectric sheet that is located between the electrodes is polarized and formed as an active portion.

An adhesive sheet (not shown) made of synthetic resin impermeable to ink as adhesive is adhered in advance to the entire lower surface (the wide surface facing the pressure chambers 36) of this plate-type piezoelectric actuator 2. Next, the piezoelectric sheet 2 is bonded and fixed to the cavity unit 1 such that its individual electrodes 44 are arranged so as to be opposed to the corresponding pressure chambers 36 of the cavity unit 1. In addition, the flexible flat cable 3 is superposed on and pressed against the upper surface of the piezoelectric actuator 2, whereby various wiring patterns (not shown) in the flexible flat cable 3 are electrically connected to the surface electrodes, respectively.

In this aspect, as shown in driving waveforms in FIG. 9, in a normal state, a voltage is applied between all the individual electrodes 44 and the common electrode 46, and thereby the active portion is expanded between the individual electrodes and the common electrode, which reduces the volume of all the pressure chambers 36. By stopping application of the voltage to each of the individual electrodes 44 in the laminating direction (lowering driving pulses), which is corresponding to a pressure chamber 36 intended to eject ink, the active portion returns to its contracted state, which increases the volume of the pressure chamber. Thereafter, by applying a voltage to the individual electrode 44 (raising driving pulses), ink is ejected. Incidentally, the invention is also applicable to a structure in which the volume of the pressure chambers 36 is reduced by raising driving pulses and ink is ejected by lowering driving pulses.

Next, a method of testing the inkjet printer 200 and inkjet head 100 thereof, which are configured as above, will be described referring to a block diagram shown in FIG. 7. This inkjet printer 200 has a configuration that is tested while actually performing recording, with the inkjet head 100 mounted on the carriage 10.

The inkjet printer 200 includes a gate array circuit 51 that controls recording operation, such as print data processing, a carriage encoder 58 that detects the position of the carriage 10, a CPU 52 that controls the whole inkjet printer 200, a ROM 59 that stores all control programs, a RAM 60 that stores temporary data accompanied with the control, a manipulation panel 64 including keys that set manipulation and a display that displays the set state, an interface 53 for connection with a computer system PC63, such as a personal computer that outputs print (recording) data, an image memory 54 that stores the print data when it has received the data from the system PC63, a carriage-moving CR motor 62 (refer to FIG. 1) and a sheet-conveying LF motor 56 that are connected to the CPU via respective driving circuits, a sensor 56 for detecting the origin point of the carriage, a sheet feed sensor 57 that detects whether or not a recording medium is in a print (recording) position, a head driver 61, the inkjet head 100 including nozzle rows corresponding to the four colors of Y, M, C and Bk, a power source (not shown), etc.

The ROM 59 stores basic driving waveform data (as will be described later) obtained by converting a plurality of kinds of basic waveforms to drive the inkjet printer 100 into data, and modification data (as will be described later) to modify the basic driving waveform data.

A method of testing using the testing system will be described referring to a flow chart of FIG. 8. First, manufactured inkjet printers 100 are sorted into a plurality of groups in advance (Step S01). This classification is carried out in advance based on known information on ejection characteristics of manufactured inkjet heads. In this aspect, flow passage resistance, etc., in the ink flow passage of the cavity unit 1 are used as the ejection characteristics of the heads. The flow passage resistance can be estimated by supplying fluid for a predetermined period of time using a pump (not shown) in the ink flow passage of the cavity unit 1 and measuring the flow rate of the fluid that has flown for the predetermined period of time, as disclosed in, for example, JP-A-2002-225287. The diameter of the nozzles 35 to 38 are also reflected on the flow passage resistance. Alternatively, a value obtained by separately measuring only the diameter of the nozzles and converting the measured value into a resistance value may be added to a total of the flow passage resistance. In addition, the electrical characteristics such as electrostatic capacity and electric resistance value of the piezoelectric actuator may be measured and added using known methods. In addition, a number of manufactured inkjet heads are sorted into, for example, three groups of X, Y and Z.

On the other hand, a plurality of kinds of basic driving waveforms to be applied to the piezoelectric actuator 2 are prepared so as to correspond to every group sorted, and stored in advance as basic driving waveform data in the ROM 59 that is a storing section (Step S02). In this aspect, in order to represent gradation using an inkjet printer, dots (a large drop, a middle drop, and a small drop) having three different sizes can be formed on a recording medium. Three sets of basic driving waveforms, each including basic driving waveforms for the large drop, the middle drop, and the small drop, are prepared for one inkjet head.

The large drop, the middle drop and the small drop are used to indicate the size of dots to be formed on a sheet for one piece of print data. As shown in FIG. 9, a driving waveform for the large drop consists of a plurality of driving pulse signals that perform twice ejection operations and an operation that cancels residual vibration, after the ejection operations. A driving waveform for the middle drop consists of a plurality of driving pulse signals that performs a single ejection operation and an operation that cancels residual vibration, after the ejection operation. A driving waveform for the small drop consists of a plurality of driving pulse signals that perform a single ejection operation and an operation that pulls back an ink droplet that has began to be ejected, after the ejection operation.

In this aspect, a total of five kinds of basic driving waveforms are prepared. Among them, Waveform No. 1 indicates a waveform for the small drop, Waveform No. 2 indicates a waveform for the middle drop, three Waveform Nos. 3 to 5 indicate waveforms for the large drop. Accordingly, as shown in FIG. 10A, a plurality of sets of basic driving waveforms, each set being obtained by combining a waveform for the small drop, a waveform for the middle drop, and a waveform for the large drop, are all three (denoted by Set No. 1 to 3). In the classification of the inkjet heads 100, Group X correspond to Set No. 1, Group Y corresponds to Set No. 2, and Group Z corresponds to Set No. 3. In addition, in this aspect, the set numbers correspond to identification numbers of basic driving wave data. However, for example, when the driving waveforms are not combined as sets, the waveform numbers themselves may be used as the identifying numbers of the basic driving waveform data.

As shown in FIG. 9, (A) to (F) as pulse names are respectively added in time series to the widths of driving pulse signals in the basic driving waveforms of Waveform Nos. 1 to and the intervals between terminal ends of the driving pulse signals and start ends of the next driving pulse signals. In addition, in FIG. 9, numerical values described above the pulse names (A) to (F) are values of pulse widths whose unit is μm. Basic driving waveform data obtained by converting the pulse names and pulse widths of FIG. 9 into data is shown in FIG. 10B. In the basic driving waveform data, the pulse names (A) to (F) are substituted with numerical values 1 to 6, respectively. Next, a plurality of kinds of modification data to partially modify the basic driving waveform data are prepared, and stored in advance in the ROM 59 that is the storing section (Step S03). The modification data may be created so as to be able to modify all kinds of the driving pulse data and all the pulses. In that case, however, the amount of data becomes. Thus, the modification data is created by estimating a point having a highest frequency of modification in advance. In addition, the modification data is created such that one type of modification data can be applied to a plurality of kinds of the basic driving pulse data. Accordingly, the amount of the modification data can be reduced, and the modifying work of the basic driving waveforms, as will be described later, can be simplified.

In this aspect, the modification data has all six types (to which Modification Nos. 1 to 6 are given). The contents of the modification data, as shown in FIG. 10C, are sorted into items "Start Waveform No.", "Number of Waveforms", "Increment", "Pulse Name", and "Unit Modification Amount". The three items "Start Waveform No.", "Number of Waveforms", and "Increment" indicate to which driving waveform data of Waveform No. 1 to 5 the modification data is applied. For example, Modification No. 4 is applied to Waveform Nos. 3 and 4. Specifically, Modification No. 4 indicates that a modification program for the basic driving waveforms is first applied to "Start Waveform No." 3 and applied to a total two waveforms of "Number of Waveforms", and after Waveform No. 3, the modification program is applied to Waveform No. 4 by incrementing Waveform No. 3 by one. In addition, in the case of Modification No. 6, since the modification program is first applied to Start Waveform No. 5 and applied to only a total of one waveform of Number of Waveforms, Increment 1 becomes negligible data.

The item "Pulse Name" indicates pulse names of points required to be modified, among the pulse names of the driving waveforms (A) to (F) ((1) to (6) of FIG. 10B) shown in FIG. 9. The item "Unit Modification Amount" indicates numerical values to be used as references of the modification amount. The modification amount when a pulse is modified is determined by multiplying the "Unit Modification Amount" by multiplying factor information (multiplying factor data) included in individual pieces of waveform information. Although a form in which at most two points to be modified are included in one type of modification data is exemplified in this aspect, three or more points to be modified may be included in one type of modification data. In that case, pairs of items "Pulse Name" and "Unit Modification Amount" are prepared as much as the number of points to be modified.

As the multiplying factor information (multiplying factor data), in this aspect, as shown in FIG. 10D, four types (to which Multiplying Factor Numbers 1 to 4 are given) of multiplying factor information are provided. "Unit Modification Amount" is multiplied by −2 in Multiplying Factor Number 1, by −1 in Multiplying Factor Number 2, by 1 in Multiplying Factor Number 3, and by 2 in Multiplying Factor Number 4, respectively. For example, if Modification No. 6 and Multiplying Factor No. 4 are selected in the individual waveform formation, as to the driving waveform of Waveform No. 5 to which Modification No. 6 is applied, that is, Waveform III for the large drop, the point of Pulse Name 3(C) of the waveform is modified by 0.2×2=0.4 μsec, and changed from 4 μsec to 4.4 μsec, and at the same time, and the point of Pulse Name 4(D) of the waveform is modified by −0.2×2=−0.4 μsec, and changed from 6 μsec to 5.6 μsec.

Next, the set number of the basic driving waveform data for an inkjet head 100 to be tested is determined (Step S04) based on a group to which the inkjet head 100 belongs. In this aspect, the inkjet head 100 to be tested is assumed to belong to Group Y, and Set No. 2 is determined (refer to FIG. 10A).

First, since the basic driving waveform is applied to the inkjet head 100 without any modification, individual waveform information including a set number of the determined basic driving waveform data and the information showing that the set number is not modified is created (Step S05). The individual waveform information is created by a three-digit figure input to the PC63 (see FIG. 7). If the three-digit figure of the individual waveform information is expressed by "abc" shown in FIG. 10E, a figure substituted for "a" indicates the set number of the basic driving waveform data, which is selected from Set No. 1 to 3 of FIG. 10A. A figure substituted for "b" indicates which modification data is used, which is selected from Modification No. 1 to 6 of FIG. 10C. A figure substituted for "c" indicates a multiplying factor by which Unit Modification Amount is multiplied, which is selected from Multiplying Factor No. 1 to 4 of FIG. 10D. In addition, when zeros are selected as both figures substituted for "b" and "c" of the individual waveform information, this indicates that the basic driving waveform data is not modified.

Accordingly, in the inkjet head 100 of Group Y to be tested, since the basic driving waveform data of Set No. 2 is used without any modification, "200" is created as the individual waveform information.

The individual waveform information created in this way is input by key manipulation from the manipulation panel 64. For example, the key manipulation allows the individual waveform information to be input to a predetermined region of the RAM 60 according to the guidance to be displayed on a liquid crystal display. Otherwise, the individual waveform information can be input through the I/F 53 by reading barcodes, figures, etc., attached in advance to an inkjet head 100 using a reader. Then, when recording (print) for testing is transmitted via the I/F 53 from the PC63 and recording (print) is requested, the data requested from the ROM 59 is read out to create a driving waveform based on a three-digit figure of the individual waveform information according to a program. The driving waveform is applied to the piezoelectric actuator 2 of the inkjet head 100, and thereby predetermined recording (print) patterns are recorded on the print sheet.

This recording is performed as to each of the small drop waveform of Waveform No. 1, the middle drop waveform of Waveform No. 2, and the large drop waveform II of Waveform No. 4, for example, when the individual recording waveform was "200". The recording data for testing transmitted from the PC 63 is data to use these ink drops. Then, a recording state is observed (S06).

When the recording state is good (Yes in Step S07), the individual waveform information "200" is determined as final individual waveform information (Step S11), and a driving waveform of this waveform information is used in an inkjet printer equipped with the inkjet printer 200 concerned. On the other hand, when the recording state is bad (Step S07), modification data and multiplying factor data to be applied to the basic driving waveform data are determined from observation and examination of the bad state, and thereby individual waveform information is created again (Step S08). The individual waveform information input by the manipulation panel 64 are modified by changing the previously created individual waveform information "200" so as to include Set No., Modification No. and Multiplying Factor No. of a driving waveform. For example, in the recording patterns created by the "200", when recording by a large ink drop is bad, a waveform number that needs modification is 4. Therefore, the individual waveform information is modified to "241" by selecting Modification No. 4 of FIG. 10C, and assuming that Multiplying Factor No. 1 is selected.

In this individual waveform information "241", as to Waveform II for the large drop, the point of Pulse Name 3(C) is modified by 0.2×(−2)=−0.4 μsec, and changed from 5 μsec to 4.6 μsec. This waveform is applied to the inkjet printer 100 and then the recording state of the printer is observed again (Step S09). In addition, since Modification No. 4 is selected, only Waveform II for the large drop is modified, and the small drop waveform and the large drop waveform are not modified.

Then, when the recoding state is bad (Step S10) at this point, the individual waveform information is modified and then the procedure from Step S08 is repeated until the recording state becomes good (Yes in Step S10).

When the recording state becomes good (Yes in Step S10) with the individual waveform information "241", the individual waveform information "241" is determined as final individual waveform information (Step S11), and the driving waveform of this waveform information is used in the inkjet printer concerned.

Here, when a waveform number that needs modification has been determined, all combinations of the correction numbers and the multiplying factor numbers 1 to 4, which are corresponding to the waveform number, are sequentially changed by a program, or individual waveform numbers corresponding to the combinations are sequentially specified by the manipulation panel 64. Then, recording (print) patterns are formed using all the driving waveforms obtained by combining each of the correction numbers with each of the multiplying factors. Then, among the resulting patterns, a driving waveform that shows the best recording pattern can be used as the driving waveform in the inkjet printer concerned.

In addition, the input and modification of the individual waveform information can be performed from the PC63 connected to the inkjet printer 200.

Further, recording (print) patterns for testing and testing programs may be stored in the inkjet printer 200 so that each processing for testing can be performed without using the above PC63. Moreover, it is possible to employ a construction in which the PC63 is connected to an apparatus having functions equivalent to the above inkjet printer 200, thereby constructing an exclusive testing system 50, so that individual waveform information determined with respect to each inkjet head is given to the inkjet head by inputting or modifying the individual waveform information from the PC63. In this case, the individual waveform information is written in barcodes on a label, or the like, and then the label is adhered to the inkjet head. Otherwise, the individual waveform information is stored in an IC chip mounted on the inkjet printer, and then, when the inkjet head 100 is mounted on the inkjet printer 200, the information is written in the RAM of the inkjet printer 200.

As described above, this aspect is configured such that, when a driving waveform for an inkjet head is optimized, the driving waveform is divided into basic driving waveform data and modification data corresponding thereto, which are in turn combined. Moreover, the unit modification amount of the modification data is combined with and multiplied by separately prepared multiplying factor data. In other words, in this aspect, various kinds of correction are possible. In this case, since the correction is made by combinations of various kinds of data, the amount of data to be stored in advance can be made small, which reduces the storage capacity of a storing section to store the data. As a result, the cost can be reduced.

Further, if an optimal driving waveform is not created even by the combinations of various kinds of data as mentioned above, additional modification data can be transmitted to a storing section (RAM) from the PC63, thereby enlarging the range of the combinations. Thus, the convenience is excellent.

Moreover, since narrowing of appropriate driving waveforms is performed by previous grouping of inkjet heads based on known information thereon, complication of testing work can be alleviated.

As described above, according to the aspect of the invention, the modification data includes information on a modification point in the basic driving waveform data, and information on unit modification amount at the modification point, and the individual waveform information includes information on multiplying factor to which the unit modification amount of the modification data is multiplied.

Since the unit modification amount included in the modification data and the information on the multiplying factor included in the individual waveform information are combined together and the amount of modification to driving waveforms is determined based on the combination, modification to the basic driving waveform data can be diversified. In other words, since it is not necessary to prepare a number of kinds of modification data having different modification amounts in advance, the storage capacity required to store the modification data can be reduced.

Further, according to the aspect of the invention, the modification data is formed such that one piece of the modification data is applicable to a plurality of pieces of the basic driving waveform data.

Since it is not necessary to prepare and store modification data for every driving waveform data to be applied, the storage capacity can be reduced.

Further, according to the aspect of the invention, there is provided the system of testing an inkjet head, the inkjet head including a plurality of nozzles, a plurality of pressure chambers communicating with the nozzles, respectively, a cavity unit having an ink flow passage along which ink from an ink supply source reaches to the nozzles via the pressure chambers, and an actuator that is displaced by application of a driving waveform to selectively apply ejection pressure to each pressure chamber, the inkjet head ejecting ink drops from the nozzles to perform recording on a recording medium, the system including: a first storing section that stores a plurality of kinds of basic driving waveforms prepared so as to correspond to respective groups of inkjet heads sorted on the basis of known information about ejection characteristics of the inkjet heads, as basic driving waveform data in association with identification information of the basic driving waveforms; a second storing section that stores a plurality of kinds of modification data to partially modify the basic driving waveform data in association with identification information; a creating section that creates, with respect to an inkjet head to be tested, at least one of individual waveform information including the identification information of the determined basic driving waveform data and information showing that the basic driving waveform data is not modified, and individual waveform information including the identification information of the determined basic driving waveform data and the identification information of the modification data to modify the basic driving waveform data, on the basis of the basic driving waveform data determined according to the group to which the inkjet head belongs; and an output section that creates at least one of the driving waveform without modification of the basic driving waveform data and the driving waveform with modification of the basic driving waveform data to output the created driving waveform to the actuator.

Further, according to the aspect of the invention, there is provided the inkjet printer including: an inkjet head including a plurality of nozzles, a plurality of pressure chambers communicating with the nozzles, respectively, a cavity unit having an ink flow passage along which ink from an ink supply source reaches to the nozzles via the pressure chambers, and an actuator that is displaced by application of a driving waveform to selectively apply ejection pressure to each pressure chamber, the inkjet head ejecting ink drops from the nozzles to perform recording on a recording medium; a first storing section that stores a plurality of kinds of basic driving waveforms prepared so as to correspond to respective groups of inkjet heads sorted on the basis of known information about ejection characteristics of the inkjet heads, as basic driving waveform data in association with identification information of the basic driving waveforms; a second storing section that stores a plurality of kinds of modification data to partially modify the basic driving waveform data in association with identification information; a creating section that creates, with respect to the inkjet head, at least one of individual waveform information based on the basic driving waveform data determined according to the group to which the inkjet head belongs, and individual waveform information modified with the modification information to partially modify the basic driving waveform data; and an output section that creates at least one the driving waveform without modification of the basic driving waveform data and the driving waveform with modification of the basic driving waveform data to output the created driving waveform to the actuator.

Since a driving waveform to adapt to each inkjet head is created based on the basic driving waveform data or by combinations of the basic driving waveform data with the modification data, even if a number of driving waveforms are not prepared and stored in advance, various driving waveforms can be created, and thereby the manufacturing cost can be reduced by virtue of the reduction in storage capacity.

Further, the inkjet heads can be driven in their optimal states on the basis of information on driving waveforms inherent to the heads.

Incidentally, the first storing section and the second storing section may be provided by the single ROM 59.

In addition, the basic driving waveform data, the modification data, the multiplying factor data, and the grouping of inkjet heads, which are exemplified in the above aspect, are just illustrative, and the kind or number of data can be appropriately changed. Further, the configuration or digit number of the individual waveform information is not limited to the above aspect.

In the above-described aspect, the width of each pulse which forms the basic driving waveform is modified, however, the present invention is not limited thereto. For example, another aspect in which the pulse height value (voltage value) is modified is also applicable. In addition, each pulse which forms the basic driving waveform is not necessarily be a square pulse, and may be a pulse that has an inclined leading edge and/or an inclined trailing edge. In such a case, the present invention may modify the inclination of each of those edges. That is, the pulse rise time and/or the pulse fall time may be modified. Further, the present invention may modify the pulse width, the pulse height and the inclination of each pulse which forms the basic driving waveform in combination.

What is claimed is:

1. An inkjet printer comprising:

an inkjet head including a plurality of nozzles, a plurality of pressure chambers communicating with the nozzles, respectively, a cavity unit having an ink flow passage along which ink from an ink supply source reaches to the nozzles via the pressure chambers, and an actuator that is displaced by application of a driving waveform to selectively apply ejection pressure to each pressure chamber, the inkjet head ejecting ink drops from the nozzles to perform recording on a recording medium;

a first storing section that stores a plurality of kinds of basic driving waveforms prepared so as to correspond to respective groups of inkjet heads sorted on the basis of known information about ejection characteristics of the inkjet heads, as basic driving waveform data in association with identification information of the basic driving waveforms;

a second storing section that stores a plurality of kinds of modification data to partially modify the basic driving waveform data in association with identification information;

an information input section that receive individual waveform information, with respect to the inkjet head, which includes the identification information based on the basic driving waveform data determined according to the group to which the inkjet head belongs, and the identification information related to the modification data; and an output section that creates the driving waveform with modification of the basic driving waveform data, based on the received individual waveform information, to output the created driving waveform to the actuator.

2. The inkjet printer according to claim 1, wherein the modification data includes information on a modification point in the basic driving waveform data, and information on unit modification amount at the modification point, and the individual waveform information includes information on multiplying factor to which the unit modification amount of the modification data is multiplied.

3. The inkjet printer according to claim 1, wherein the modification data is formed such that one piece of the modification data is applicable to a plurality of pieces of the basic driving waveform data.

4. The inkjet printer according to claim 1, wherein the known information about ejection characteristics of the inkjet heads comprises at least one of resistance information of the ink flow passage and electrical characteristics information of the actuator.

5. The inkjet printer according to claim 1, further comprising an information holding section having the individual waveform information on the inkjet head.

6. The inkjet printer according to claim 5, wherein the information holding section comprises a label on which the individual waveform information is recorded as at least one of a bar code and a number.

7. The inkjet printer according to claim 5, wherein the information holding section comprises an IC chip in which the individual waveform information is stored as data.

8. The inkjet printer according to claim 1, wherein the basic driving waveform comprises a plurality of pulses, and the basic driving waveform data comprises information on the plurality of pulses.

9. The inkjet printer according to claim 8, wherein the basic driving waveform data comprises information on a width of each pulse, and the output section modifies at least one of the width of the plurality of pulses.

10. The inkjet printer according to claim 1, wherein the individual waveform information comprises a set of at least information concerning a kind of the driving waveform to be applied to the inkjet head, information concerning the modification data and information concerning degree of application of the modification data.

11. An inkjet head for an inkjet printer, the inkjet printer including a first storing section that stores a plurality of kinds of basic driving waveforms prepared so as to correspond to respective groups of inkjet heads as basic driving waveform data in association with identification information of the basic driving waveforms, and a second storing section that stores a plurality of kinds of modification data to modify the basic driving waveform data in association with identification information, the inkjet head comprising:

a plurality of nozzles for ejecting ink;

a plurality of pressure chambers communicating with the nozzles, respectively;

a cavity unit having an ink flow passage along which ink from an ink supply source reaches to the nozzles via the pressure chambers; and an actuator that is displaced by application of a driving waveform to selectively apply ejection pressure to each pressure chamber; and a holding section which has information indicating individual wave information including the identification information based on the basic driving waveform data determined according to the group to which the inkjet head belongs and the identification information related to the modification data, wherein a driving waveform with modification of the basic driving waveform data based on the individual waveform information is to be created in the inkjet printer and output to the actuator.

12. The inkjet head according to claim 11, wherein the information holding section comprises a label on which the individual waveform information is recorded as at least one of a bar code and a number.

13. The inkjet head according to claim 11, wherein the information holding section comprises an IC chip in which the individual waveform information is stored as data.

* * * * *